United States Patent [19]

Brügger-Stuker

[11] 3,971,144

[45] July 27, 1976

[54] COMBINATION SKI BOOT AND WALKING SOLE AND CONNECTION MEANS FOR SUCH COMBINATION

[75] Inventor: Ruth Brügger-Stuker, Spiez, Switzerland

[73] Assignee: Panta AG, Zurich, Switzerland

[22] Filed: Nov. 5, 1975

[21] Appl. No.: 628,913

[30] Foreign Application Priority Data

Nov. 8, 1974 Switzerland ..... 15010/74

[52] U.S. Cl. ..... 36/100; 36/117

[51] Int. Cl.[2] ..... A43B 00/00

[58] Field of Search..... 36/2.5 R, 2.5 AL, 2.5 AN, 36/1, 7.5

[56] References Cited

UNITED STATES PATENTS 2,810,213 10/1957 Jonas ..... 36/7.5

3,665,620 5/1972 St. Clair ..... 36/2.5 AL

*Primary Examiner*—Patrick D. Lawson

*Attorney, Agent, or Firm*—Edward J. Brenner

[57] ABSTRACT

A ski boot provided with a walking sole and an attachment or connection means for securing the walking sole to the ski boot. The connection means serves to secure the walking sole at the ski boot such that the walking sole can be pivoted about at least one axis of rotation at the ski boot away from the tread surface of said ski boot into a position at the upper of the ski boot. When the walking sole assumes the position where it bears against the upper of the ski boot the skier can step into the ski binding, typically a safety binding, without the need for the walking sole to be detached i.e. carried by the skier during skiing at any other location than at the boot itself.

5 Claims, 7 Drawing Figures

COMBINATION SKI BOOT AND WALKING SOLE AND CONNECTION MEANS FOR SUCH COMBINATION

BACKGROUND OF THE INVENTION

The present invention relates to a new and improved construction of a combination ski boot and walking sole and connection or attachment means for securing the walking sole at the ski boot.

Modern day ski boots are constructed with rigid soles so that walking in such ski boots is not only uncomfortable but in many instances even painful. In order to alleviate or at least mitigate this problem there have already been constructed so-called walking soles which extend over the entire rigid sole of the boot or only cover a part thereof and permit a rolling-off or tilting-type movement of the ski boot during walking. However, a drawback of such constructions resides in the fact that the walking soles of necessity must be taken along by the skier during skiing so that such walking soles can be again immediately remounted at the ski boots when the skier contemplates walking with the ski boots.

In an effort to permit the skier to take along the walking soles during the time that he is skiing attempts have been made to mount the walking soles upon the skis, to carry them in some manner upon the ski poles, to hang them about special support belts or the like, to store them away in pouches or backpacks, to suspend them at the buttons or zippers of the clothing or to even insert them into the pants or skiing jacket pockets or the like. Yet, it has been found that when the skier takes a fall the walking soles which are carried in some fashion at the body of the skier and which are nonetheless still relatively hard for reasons of strength can injure the skier. Furthermore, in the case where the walking soles are stored in pockets they tend to soil the linings or their outer surroundings because the snow which still clings to the walking soles oftentimes is dirty.

SUMMARY OF THE INVENTION

Hence, it is a primary object of the present invention to overcome the aforementioned drawbacks and shortcomings of the prior art proposals in this field.

Still another significant object of the present invention aims at a novel arrangement of a ski boot and walking sole and means for attaching the walking sole to the ski boot in a manner permitting storage of the walking sole at the ski boot even when the skier is skiing.

Yet a further important object of this invention aims at the provision of novel connection means for securing a walking sole to a ski boot in a manner permitting the walking sole to assume a position where the skier can walk with the boot upon the walking sole during the walking phase and during the skiing phase permitting the walking sole to remain attached to the ski boot while allowing for unhindered access of the ski boot into the binding.

Now in order to implement these and still further objects of the invention, which will become more readily apparent as the description proceeds, the invention provides a combination of a ski boot and a walking sole and connection or attachment means for securing the walking sole to the ski boot. The connection means enables the walking sole to be pivoted about at least one axis of rotation at the ski boot away from the tread surface of such ski boot into a position adjacent the upper of the ski boot. In this position there is rendered possible insertion of the ski boot into the ski binding —normally nowadays a safety ski binding— without the need for the walking sole during the skiing phase to be carried at any other location other than at the ski boot itself.

With the arrangement contemplated by the invention the skier always has an aid, namely the walking soles, permitting walking with the ski boots without any problem. Since the walking sole together with the connection means or connection element is directly mounted at the ski boot or can be rigidly connected thereat, the skier secures the walking sole upon putting on the ski boot into its walking position, walks therewith while cushioned, for instance to the next ski lift, while carrying out a comfortable rolling-off stepping movement. When the skier has reached the intended destination, here assumed to be a ski lift, the skier conveniently pivots the walking sole with a simple hand movement or manipulation about an axis of rotation towards the rear against the upper of the ski boot and with a further easy manipulation secures such thusly-positioned walking sole at the upper of the ski boot.

The connection element or connection means providing the attachment between the walking sole and ski boot can also be mounted at the region of the toe box or else at the heel or heel region of the ski boot. Such connection means can be constructed as a permanent, non-detachable connection or as a plug-type or threadable-type connection which then constitutes a releasable connection or attachment.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
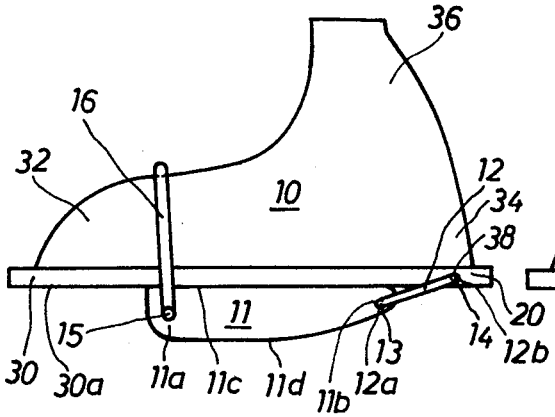
FIG. 1 schematically illustrates an arrangement of a ski boot, walking sole and connection means for securing the walking sole at the ski boot, the walking sole being shown in FIG. 1 in the walking position.
Figure 2:
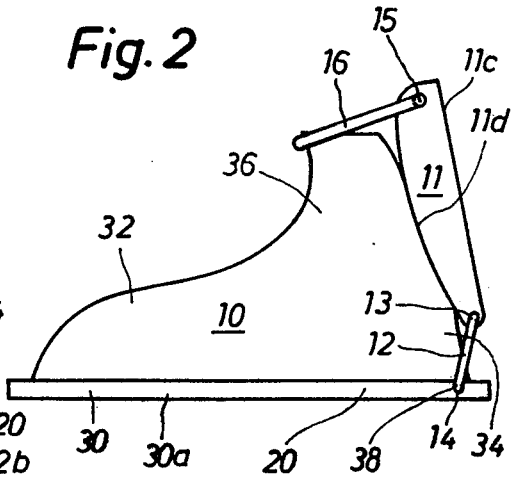
FIG. 2 illustrates the arrangement of FIG. 1, but this time with the walking sole pivoted to a position where the ski boot can be inserted into a ski binding.

Describing now the drawings, in FIGS. 1 and 2 there will be recognized a ski boot 10 including a ski boot sole 30 extending between the toe box 32 and the heel portion 34 of such ski boot 10. As is conventional the ski boot 10 is provided with an upper 36. The ski boot sole 30 provides at its under face a tread surface 30*a*. It is to be understood that the invention is not limited to any specific construction of ski boot, and thus, basically any ski boot can be utilized in practising the teachings of the invention.

Regardless of the specific construction of ski boot which may be utilized the same is provided, as contemplated by the invention, with a walking sole 11 which can be moved between the position of FIG. 1 when the skier is walking with the ski boot, into the position shown in FIG. 2, normally assumed when the skier is skiing with the ski boot. The walking sole 11 is pivotably connected with the ski boot 10 by the connection means or connection element 12. In particular, the connection element 12 includes a connection element portion 12*a* which is pivotably connected with the walking sole 11 and a connection element portion 12*b* which is pivotably connected with the ski boot, e.g. the heel region 20 of sole 30 of such ski boot. As will be apparent from the discussion to follow and evident to those skilled in the art the connection element or connection means 12 is similarly connected with the walking sole 11 and the ski boot 10 at the opposite side from that shown in FIG. 1. Further, there is provided any suitable fixation or securing means 16, preferably adjustable in length, for instance a strap, belt, band or the like, which is secured in any convenient fashion at both sides at locations 15 of the walking sole 11. This fixation or securing means 16 serves to fixedly retain the forward portion 11*a* of the walking sole at the ski boot 10, whether the same is secured in the position of FIG. 1 or that of FIG. 2. In the showing of FIG. 1 it will be seen that the fixation or securing means 16 extends about the region of the toe box 32 of the boot 10, thereby fixing the walking sole 11 in the walking position below the ski boot sole 30, whereas in the showing of FIG. 2 the walking sole 11 is fixed against the upper by the fixation or securing means 16 which is wrapped about such ski boot upper.

The connection element or connection means 12 can be conveniently secured to the walking sole 11 at the locations 13 which then define an axis of rotation. For instance, the connection element portions 12*a* can be pivotably inserted into bores 11*b* provided at the walking sole 11. Further, connection element portions 12*b* are secured at locations 14 at the region of the heel portion of the ski boot, at both sides of such ski boot, with the aid of suitable mounting means, generally indicated by reference character 38, and which mounting means may be constituted, by way of example, by screws, pawls, hooks, eyelets, snaps, rivets, snap-button fasteners or equivalent structure, such that the connection element or connection means 12 with the mounting means 38 or simply the connection means 12 while mounted at such mounting means 38 can carry out a pivotal or arcuate movement over approximately three-quarters of a circular arc. The locations 14 where the connection element portions 12*b* are secured to the ski boot 10 define an axis of rotation for the connection element or connection means 12. The connection element or connection means 12 can be constituted by any suitable structure. For instance, it may comprise two substantially U-shaped connection brackets, one located at each side of the ski boot and having the flexed connection portions 12*a* and 12*b* hingedly anchored at the walking sole 11 and the ski boot 10. The connection element or connection means 12 also can be constituted by a single substantially U-shaped bracket or connection member, for instance of the type shown in FIG. 3, wherein the same includes the confronting connection element portions 12*b* which can be secured to the ski boot 10 and a continuous connection element portion 12*a* which extends through continuous bore 11*b* of the walking sole 11. What is important is that the connection element or connection means 12, regardless of its construction, allows for the pivotal movement of the walking sole 11 between the walking position shown in FIG. 1 and the "out-of-the-way" position, typically where it bears against the upper 36 of the ski boot 10, when the ski boot is used for skiing.

Figure 3:
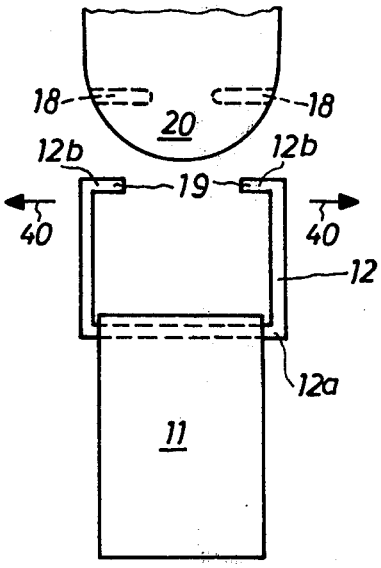
FIG. 3 is an exploded fragmentary bottom view of a modified arrangement for connecting the walking sole with the ski boot.

Continuing, and referring now to the modified arrangement of FIG. 3 it is possible to provide, instead of the mounting means 38 at the locations 14, a pair of confronting or oppositely situated blindhole bores 18, for instance formed at the ski boot sole 30, into which there can be ratcheted or plug-connected or otherwise suitably fixed the flexed ends 19 of a clamping, resiliently biased connection element 12, the flexed ends 19 forming the connection element portions 12*b* as above disclosed. The connection element portion 12*a*, located opposite the flexed ends 19, then conveniently extends through the aforementioned continuous bore 11*b* provided at the walking sole 11. With this arrangement the walking sole 11 together with the connection element 12 can be easily detached from the ski boot, particularly from the bottom visible heel portion 20 of FIG. 3 by spreading apart the connection element portions 12*b* in the direction of the arrows 40 shown in FIG. 3. Instead of the connection element 12 having the flexed ends 19 there can also be provided eyelets or bores which engage in suitable mounting means, for instance of the type disclosed above, which are then provided instead of the bores 18 at the heel or heel portion of the ski boot 10.

Figure 4:
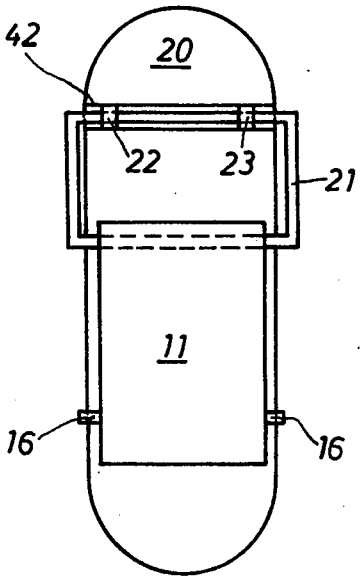
FIG. 4 schematically illustrates in bottom plan view a still further variant arrangement for securing a walking sole to the ski boot.

In FIG. 4 there is illustrated a further variant embodiment of the invention as viewed from below wherein the connection element 21, to the extent possible consists of a single piece or member which is inserted or cast into the walking sole 11. In the heel region 20 which is visible from the underside in the showing of FIG. 4 there is machined or otherwise formed a groove 42 where the connection element or connection means 21 is held at locations 22 and 23 in any suitable manner, for instance as above described, so that there is insured for the requisite rotational movement discussed above.

Figure 5:
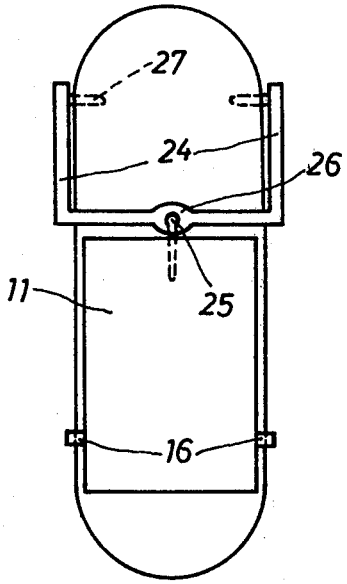
FIG. 5 illustrates in bottom plan view yet a further arrangement for securing a walking sole to the ski boot.
Figure 6:
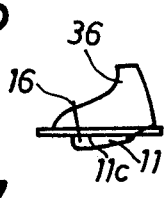
FIG. 6 schematically illustrates the arrangement of FIG. 5 wherein the walking sole is in a position permitting walking thereon.
Figure 7:
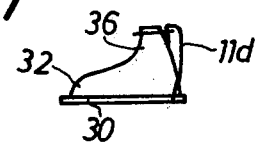
FIG. 7 is a view similar to the showing of FIG. 6, but illustrating the walking sole in its pivoted-up position where it bears against or is directed towards the upper of the ski boot, permitting insertion of such ski boot into the safety ski binding for instance.

In FIGS. 1 to 4 there have been disclosed different possibilities of connection elements or connection means which enable placement of the walking sole into the desired mode of use, for example the walking mode or the skiing mode, by simply pivotably moving such walking sole. With these embodiments the portion 11*c* of the walking sole 11, which sole portion 11*c*, during the walking mode, bears against the ski boot sole 30 or, stated in another way, the portion 11*c* at which the ski boot sole 30 bears during walking with the ski boot, following pivoting of the walking sole back into the position of FIG. 2, preparatory to skiing, is located away from the ski boot upper 36. It should thus be apparent that the portion or part 11*d* of the walking sole 11 which contacts the ground or surface upon which the skier walks, during the skiing phase, with the walking sole 11 positioned as shown in FIG. 2, directly contacts or bears against the upper 36 of the ski boot. This could be considered to be somewhat disadvantageous. An ideal arrangement has been illustrated with the still further variant embodiment of FIG. 5 which permits rotating the walking sole 11 such that the part or portion 11*d* of such walking sole 11 which contacts the ground during walking, also during the skiing phase, is located at the outside away from the ski boot upper 36. This arrangement can be beneficially realized by particularly constructing the connection element or connection means 12 or the walking sole 11. In FIG. 5 there will be seen from below the walking sole 11 and the fixation or securing means for selectively fixing the walking sole in the walking mode-position or the skiing mode-position of FIGS. 6 and 7 respectively. There is provided a connection element or connection means 24 including the mounting means 27 for securing the connection means 24 at the ski boot, typically at the heel portion 20 of the ski boot sole 30. Reference character 25 designates a component which protrudes out of the walking sole 11 or is cast directly thereat as a part thereof and which fits into a holder or holder means 26 of the connection element 24, so that the walking sole 11 can be turned through an angle of at least 180°. The component 25 may be constituted, purely by way of example, by a ball, rivets, threading or equivalent structure which allows turning of the walking sole 11 through the aforementioned angular range. The component or member 25 thus can be rotated through approximately 180° within the holder 26 when it is desired to displace the walking sole 11 together with the fixation or securing means 16, for instance a belt, towards the rear in the direction of the ski boot upper 36, so that also in the skiing mode-position of FIG. 7 it will be recognized that the surface or part 11*d* of the walking sole 11 which comes into contact with the ground is located towards the outside i.e. away from the surface of the boot. Hence, this portion 11*d* of the walking sole 11 which may be scuffed or abraded does not come into contact with the surface of the boot, particularly the ski boot upper, and thus there is effectively precluded any possibility of damaging the surface of the boot due to this scuffed portion of the walking sole 11 which has been exposed to wear due to walking thereon.

While there is shown and described present preferred embodiments of the invention, it is to be distinctly understood that the invention is not limited thereof, but may be otherwise variously embodied and practiced within the scope of the following claims. Accordingly,

What is claimed is:

1. The combination with a ski boot having tread surface means and a walking sole of a connection element for securing the walking sole to the ski boot, said connection element including means for mounting the walking sole at the ski boot such that the walking sole can be pivoted about at least one axis of rotation at the ski boot away from the tread surface means of the ski boot into a position adjacent the upper of the ski boot, said position enabling the ski boot to be inserted into a ski binding without the walking sole, during skiing with the ski boot, having to be carried at any location other than at the ski boot itself.

2. The combination as defined in claim 1, further including a part depending from the walking sole, and said connection means includes mechanism for rotatably mounting said part depending from the walking sole so that the walking sole can be rotated about its own lengthwise axis through an angle of approximately 180°.

3. The combination as defined in claim 1, further including a part extending from the connection element, and the walking sole incorporates means with which there can be coupled said part extending from the connection element such that the walking sole can be rotated about its lengthwise axis through an angle of approximately 180°.

4. A connection element for securing a walking sole at a ski boot having a tread surface and an upper, said connection element including means for mounting the walking sole at the ski boot such that the walking sole can be pivoted about at least one axis of rotation away from the tread surface of the ski boot into a position where it is located adjacent the upper of the ski boot, and in which position the ski boot can be inserted without hinderance into a ski binding without the need for the walking sole to be carried during skiing with the ski boot at any other location but at the ski boot itself.

5. The connection element as defined in claim 4, wherein said mounting means includes means for pivotably securing the connection element at the walking sole and means for pivotably securing the connection element at the ski boot.

* * * * *